US006868965B2

(12) United States Patent
Miller et al.

(10) Patent No.: US 6,868,965 B2
(45) Date of Patent: Mar. 22, 2005

(54) METHOD AND SYSTEM FOR MULTI-PRODUCT PACKAGING

(75) Inventors: Michael T. Miller, Austin, TX (US); Anthony C. Adragna, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 70 days.

(21) Appl. No.: 10/267,343

(22) Filed: Oct. 9, 2002

(65) Prior Publication Data

US 2004/0069679 A1 Apr. 15, 2004

(51) Int. Cl.[7] ..... B65D 85/00

(52) U.S. Cl. ..... 206/320; 206/591; 206/593; 206/504

(58) Field of Search ..... 206/521.3–521.4, 206/523–524, 320, 521, 585–594, 449, 504

(56) References Cited

U.S. PATENT DOCUMENTS 2,113,459 A * 4/1938 Brundin ..... 206/521.4
2,950,820 A * 8/1960 Shiels ..... 108/2
3,232,513 A * 2/1966 Maio ..... 206/455
3,854,650 A * 12/1974 Hanaue ..... 206/521
4,213,532 A * 7/1980 Eggert et al. ..... 206/504
4,840,277 A * 6/1989 Waldner ..... 206/523
4,972,954 A * 11/1990 Dickie ..... 206/523
5,171,114 A * 12/1992 Dunn ..... 410/154
6,012,587 A * 1/2000 McCullough ..... 206/586
6,092,651 A 7/2000 Miller ..... 206/305
6,357,652 B1 3/2002 Evans et al. ..... 229/120.01
6,382,422 B1 * 5/2002 Bocek ..... 206/586
6,499,599 B1 * 12/2002 Hopkins et al. ..... 206/523

* cited by examiner

*Primary Examiner*—Jila M. Mohandesi
(74) *Attorney, Agent, or Firm*—Hamilton & Terrile LLP.; Robert W. Holland

(57) ABSTRACT

A piece of flat packaging material has an intermediate section defined by cuts and partial cuts through the packaging material thickness so that the intermediate section is pivotable at the partial cuts to extend out into a package interior and to provide packaging support between products packaged adjacent the intermediate section. In one embodiment, opposing pieces of packaging material disposed in a package support horizontal loading of information handling systems by pivoting opposing intermediate sections inward over top of a first information handling system and placing the second information handling systems over the top of the first information handling systems.

4 Claims, 6 Drawing Sheets

METHOD AND SYSTEM FOR MULTI-PRODUCT PACKAGING

BACKGROUND OF THE INVENTION

1. Field of the Invention

The present invention relates in general to the field of packaging products, and more particularly to a method and system for multi-product packaging, such as packaging plural information handling systems.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Large customers often purchase information handling systems in bulk to obtain price discounts and help ensure consistent configurations. Server purchases are also often made in groups with a given number of servers purchased to fill a server rack. Customers who purchase information handling systems in groups typically prefer to have the information handling systems packaged and delivered in groups, as opposed to individual packaging, since multiple system packaging tends to reduce the amount of packaging material used and the amount of floor space taken up by the packaged systems. Further, customers generally find it more convenient to receive related orders in a single package.

One difficulty with multi-system packaging is that a greater variety of packaging materials is generally needed to support packaging of different numbers of products, resulting in greater use of factory floor space to store the packaging materials. Another difficulty is that automated packaging systems are typically designed for use with single-product packaging and are not easily adapted to multi-system packaging. For instance, single-product packaging of information handling systems is often supported by automated equipment, such as vacu-hoists, that aid in lifting and placing information handling systems in a horizontal orientation within a package. In contrast, multi-system packaging typically involves placing information handling systems into a package with a vertical orientation that is less amenable to the use of automated packaging aids.

SUMMARY OF THE INVENTION

Therefore a need has arisen for a method and system which packages plural products, such as information handling systems, in a single package with reduced packaging materials and reduced floor space requirements.

A further need exists for a method and system which packages plural products in a single package in a horizontal orientation amenable to the use of automated packaging procedures.

In accordance with the present invention, a method and system are provided which substantially reduce the disadvantages and problems associated with previous methods and systems for multi-system packaging. A piece of packaging material is partially cut to define an intermediate section that is pivotable to a position within the package interior so that the intermediate section provides packaging support between products.

More specifically, a packaging system with opposing pieces of packaging material is disposed in a package to support plural information handling systems. Each piece of packaging material is cut and partially cut to define pivotable sections that fold into the package interior to provide package support. A bottom section of each piece of packaging material pivots into the package interior at the bottom of the package to support an information handling system placed in the package in a horizontal orientation. An intermediate section of each piece of packaging material pivots into the package interior from above the bottom information handling system to rest over the top of the bottom information handling system. The intermediate sections provide packaging support for a second information handling system which is placed in a horizontal orientation over the top of the intermediate sections and the bottom information handling system. Additional information handling systems are packaged by including an additional intermediate section for each additional packaged information handling system. A top of plural information handling systems is packaged for protection at the top of the package by pivoting a top section of each piece of packaging material into the package interior at the top of the package. In addition, side packaging is provided by pivoting a side section along each vertical axis of the package so that the packaging material of the side sections secures the information handling systems in place.

The present invention provides a number of important technical advantages. One example of an important technical advantage is that plural products, such as information handling systems, are packaged in a single package with reduced packaging materials and reduced floor space requirements. Each multi-product packaging system stores as a single flat piece of packaging material that includes one or more intermediate sections pivotable to provide packaging support between adjacent products. The flat stored configuration reduces factory space and the symmetrical design of the intermediate section allows the packaging system to be manufactured or cut after manufacture at a desired length and for packaging a desired number of products. For instance, a customer order for a desired number of servers, such as to fill a server rack, may be filled with a single package by cutting opposing packaging systems to a desired length with an appropriate number of intermediate sections for each packaging system.

Another example of an important technical advantage of the present invention is that plural products are packaged in a single package in a horizontal orientation amenable to the use of automated packaging procedures. For instance, vacu-hoists may be used to lift and place information handling systems in packages that hold the information handling systems in a horizontal orientation which each information handling system stacked vertically and separated from adjacent information handling systems by intermediate sections. Variable lengths, such as often occur with servers, are accommodated by separating opposing packaging systems by an appropriate distance. Further, packaging material is more easily recycled by pivoting sections to their flat position and returning the material to the sender.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

The present invention provides simplified packaging of multi-product orders for reduced costs and packaging time. An intermediate packaging section for each additional product pivots inward to provide packaging support between products. For instance, an order for plural information handling systems is shipped in a single package with packaging support between adjacent information handling systems provided by a folded intermediate section. For purposes of this application, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1A:
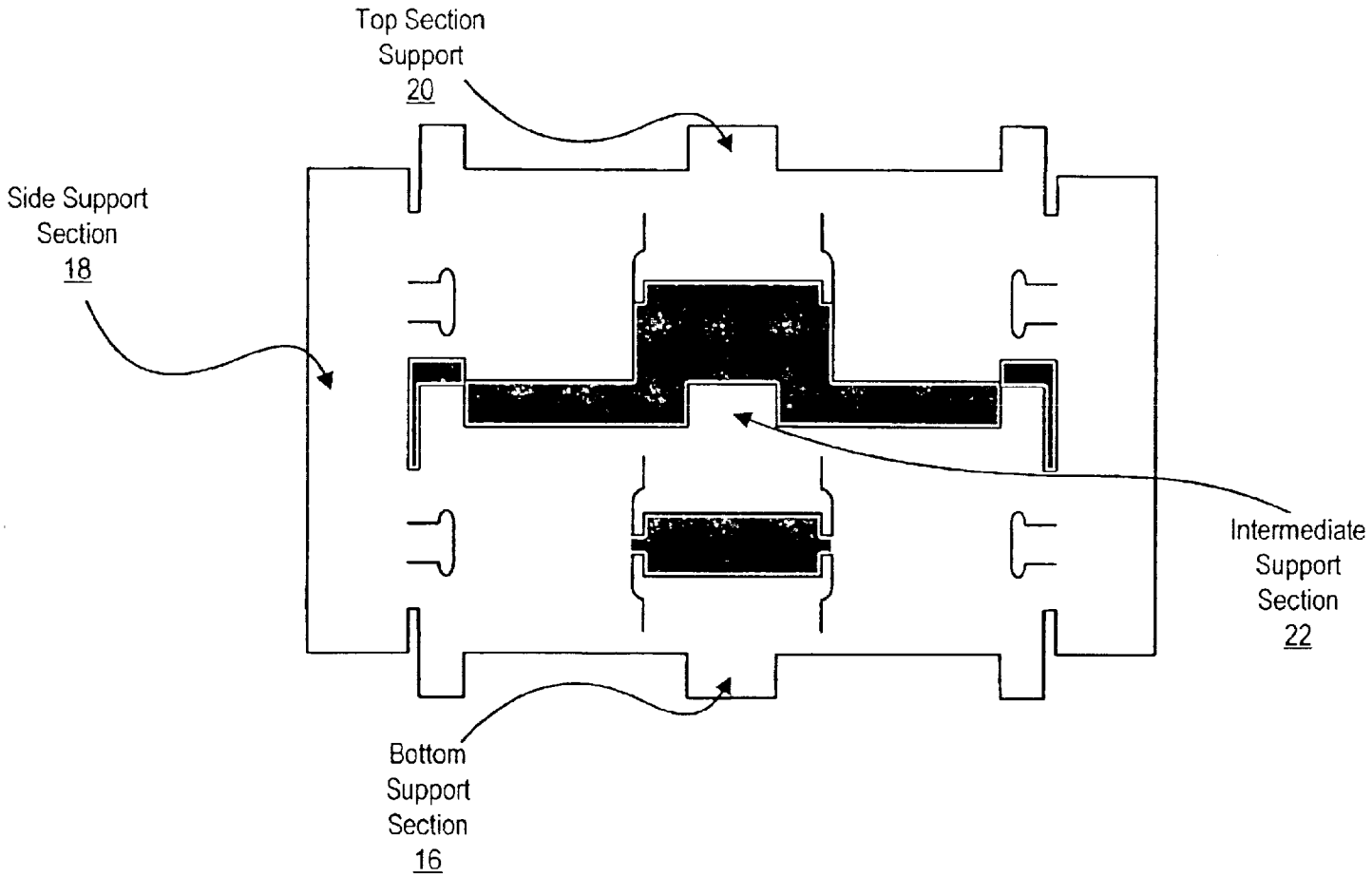
FIG. 1A depicts the surface of the packaging system that faces the interior of the package.
Figure 1B:
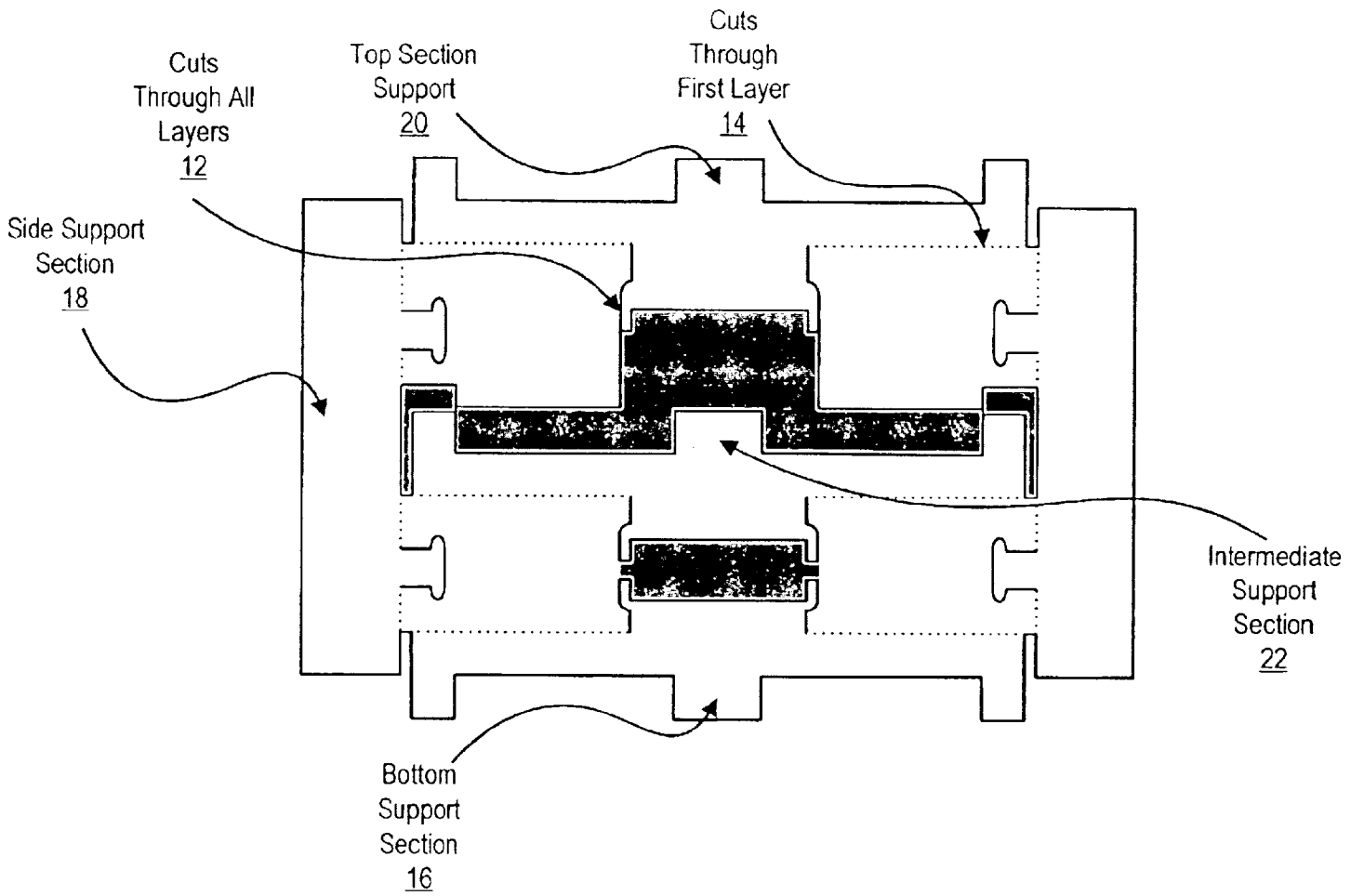
FIG. 1B depicts the surface of the packaging system that faces outward proximate the inner package surface.

Referring now to FIGS. 1A and 1B, an inner and outer view of a packaging system 10 is depicted. The inner view of packaging system 10 depicted by FIG. 1A illustrates the portion of packaging system 10 that faces inward towards the interior of a package and that contacts products being packaged. The inner surface depicted by FIG. 1A is made of a relatively thin layer of high density packaging material, such as a 0.125 inch thick layer of high density polyethylene, that is flexible and durable. The outer view of packaging system 10 depicted by FIG. 1B illustrates the portion of packaging system 10 that faces outward away from the interior of a package and that contacts the inner surface of the package. The outer surface depicted by FIG. 1B is made of a relatively thick layer of low density packaging material, such as a 2 inch thick layer of low density polyethylene, that absorbs shock in a durable manner. Cuts made in the inner and outer surface of the packaging material accommodate the folding of the packaging material inward to provide packaging support for plural products with a single piece of packaging material. Solid lines labeled as 12 in FIGS. 1A and 1B illustrate cuts that are made completely through both the inner and outer surfaces of the packaging material. Dotted lines labeled as 14 in FIG. 1B illustrate cuts that are made through the outer surface packaging material but not the inner surface packaging material. For the partial cuts illustrated by the dotted lines 14, the uncut inner surface material beneath the cut outer surface material acts as a hinge to allow pivoting of the packaging material inward towards the package to provide packaging support.

The arrangement of cuts and partial cuts in the packaging material of packaging system 10 divides the packaging material into plural pivotable sections that fold inward to provide packaging support for products. A bottom support section 16 pivots inward to provide packaging support between a bottom product that rests on the inner surface and the bottom of a package. Opposing side support sections 18 pivot inward to provide packaging support along the vertical sides of the package. A top section 20 pivots inward to provide packaging support between a top product and the top of a package. An intermediate support section 22 is defined between the top section 20 and bottom section 16 to provide packaging support between products. Intermediate support section 22 pivots inward over top of a product supported by bottom section 16 to allow a second product to be placed to rest on intermediate support section 22. Thus, intermediate support section 22 provides packaging support between adjacent products. The embodiment depicted by FIGS. 1A and 1B include a single intermediate support section 22 defined to package two information handling systems, such as servers. In order to package additional products, an additional intermediate support section 22 is added for each additional product to be packaged.

Figure 2:
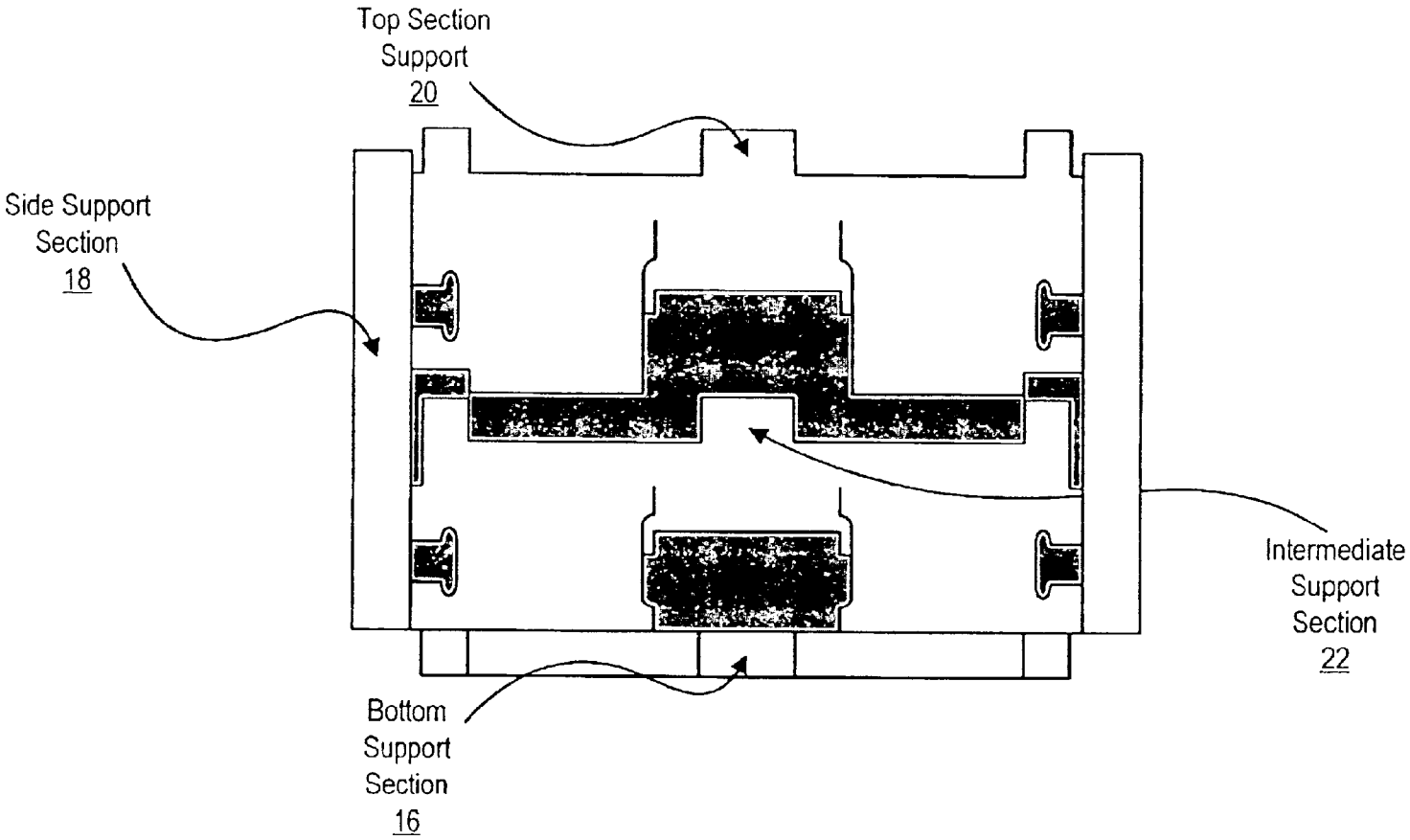
FIG. 2 depicts the packaging system prepared to accept a bottom product with the bottom and side surfaces folded to form packaging support.

Referring now to FIG. 2, packaging system 10 is depicted in a configuration that is prepared to accept a bottom product. Bottom support section 16 is pivoted inward so that the product rests on its inner surface and the outer surface rests on the bottom of a package. Side support sections 18 are pivoted inward so that the product is held in place and protected from potential impacts along the side of the package. Packaging system 10 is then placed in a package opposed to another similarly configured packaging system 10. A product is then placed horizontally in the package supported by bottom support sections 16 of opposing packaging systems 10.

Figure 3:
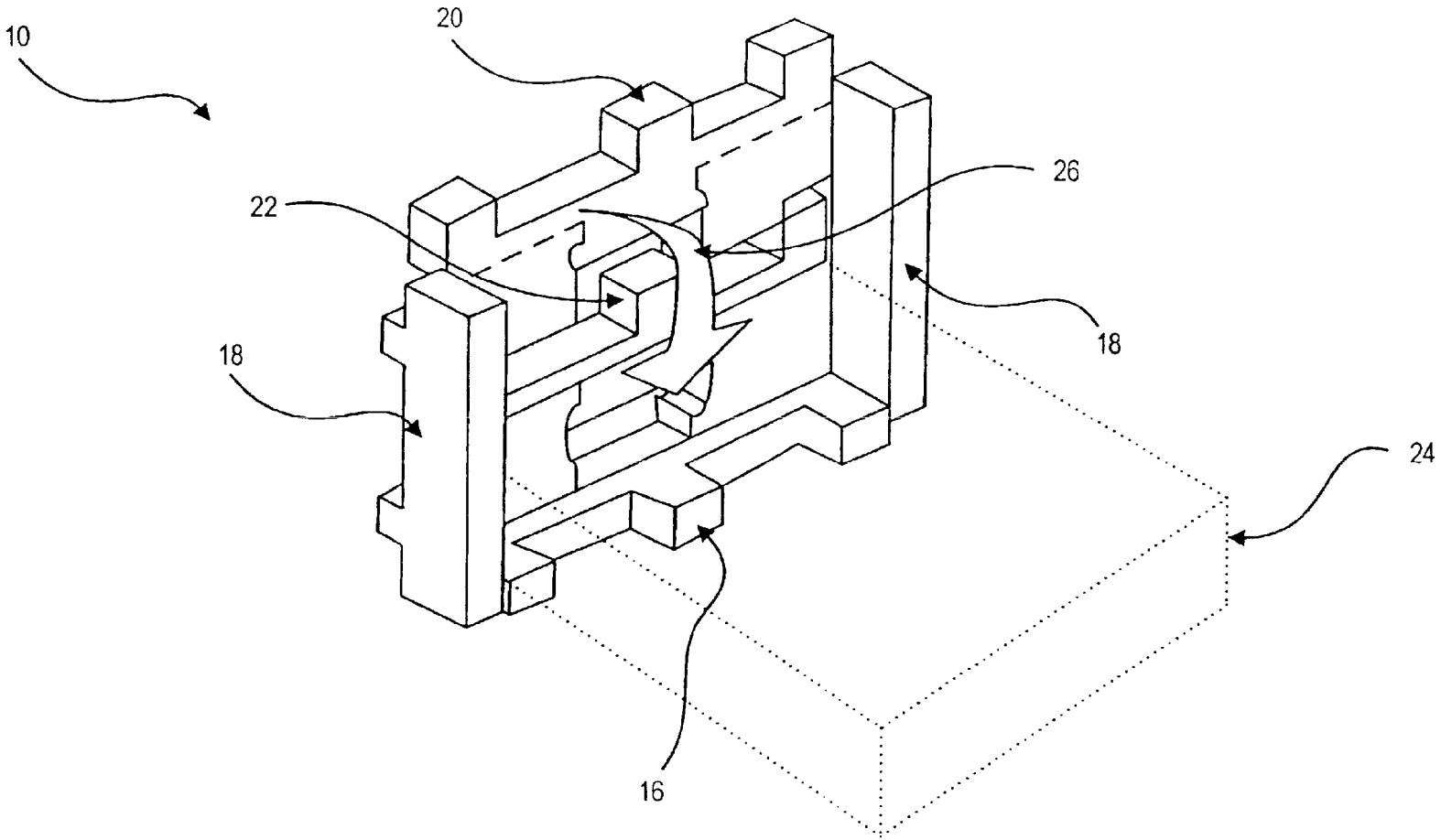
FIG. 3 depicts the packaging system supporting a first product with an intermediate section pivotable to provide packaging support to a second product.

Referring now to FIG. 3, packaging system 10 is depicted with a packaged bottom product 24, such as an information handling system. Bottom product 24 rests on bottom support section 16 and is held laterally by side support sections 18. As shown by rotation arrow 26, intermediate support section 22 pivots inward to rest on top of and hold in place bottom product 24. Although FIG. 3 is depicted without a package for clarity, packaging system 10 is sized to fit in a desired package so that bottom product 24 is placed in the package on top of bottom support 16 and intermediate support section 22 has room to pivot within the package over top of bottom product 24. FIG. 3 depicts for clarity only packaging of one end of product 24. Secure packaging of both ends is accomplished by disposing first and second packaging systems 10 in opposing ends of a package to support both ends of product 24.

Figure 4:
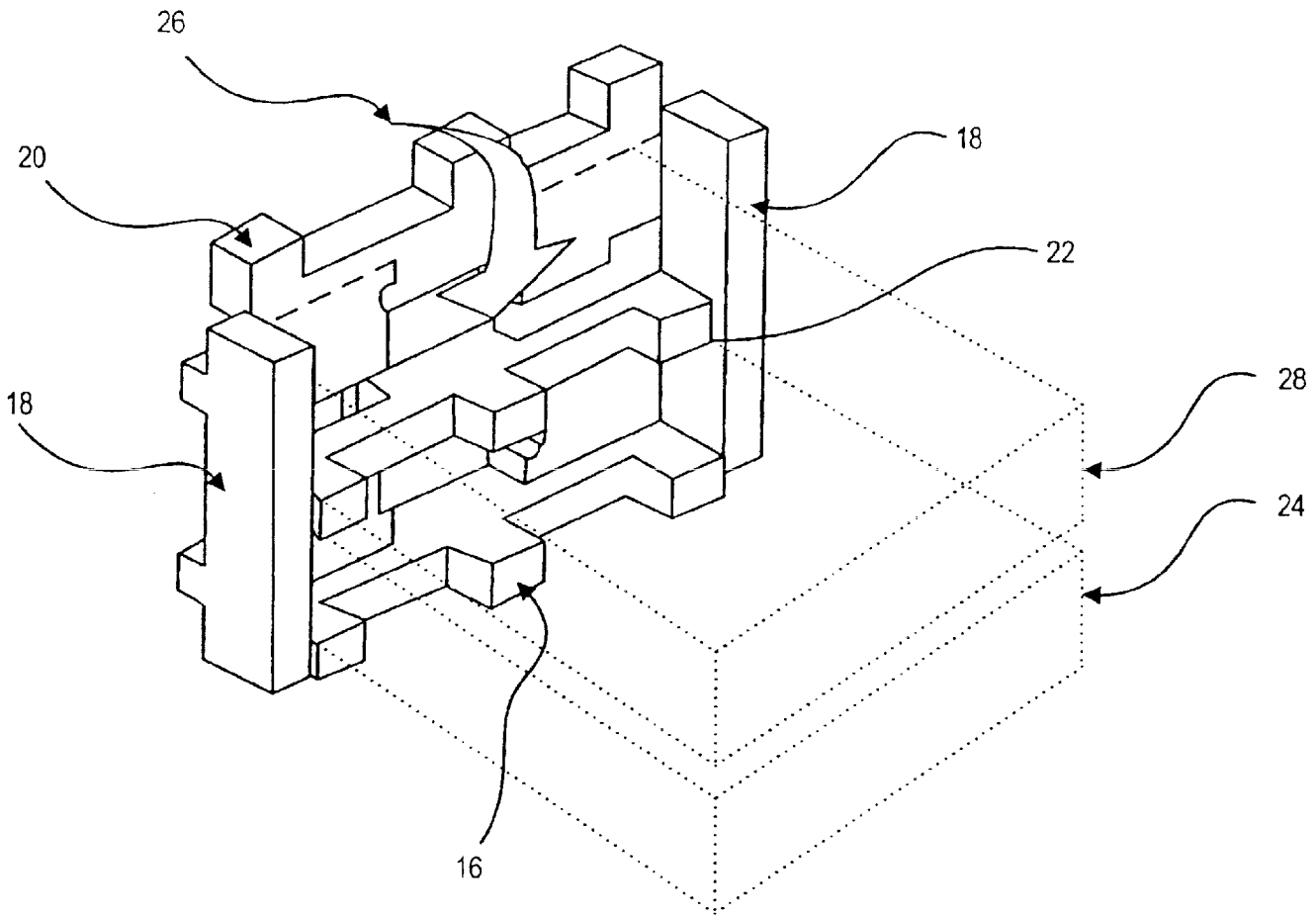
FIG. 4 depicts the packaging system supporting plural products with a top section pivotable to provide packaging support for the top product.

Referring now to FIG. 4, packaging system 10 is depicted with a packaged top product 28, such as a second information handling system. Top product 24 rests on intermediate support section 22 which has been pivoted inward to rest on bottom product 24. As shown by rotation arrow 26, top support section 20 pivots inward over top of top product 28 to provide packaging support between top product 28 and a package. In an embodiment of packaging system 10 that holds more than two information handling systems, additional intermediate sections 22 rather than a top section 20 would pivot over top product 28 so that additional products are supported in the package. Packaging system 10 has a symmetrical design that accommodates additional products by including additional intermediate sections.

Figure 5:
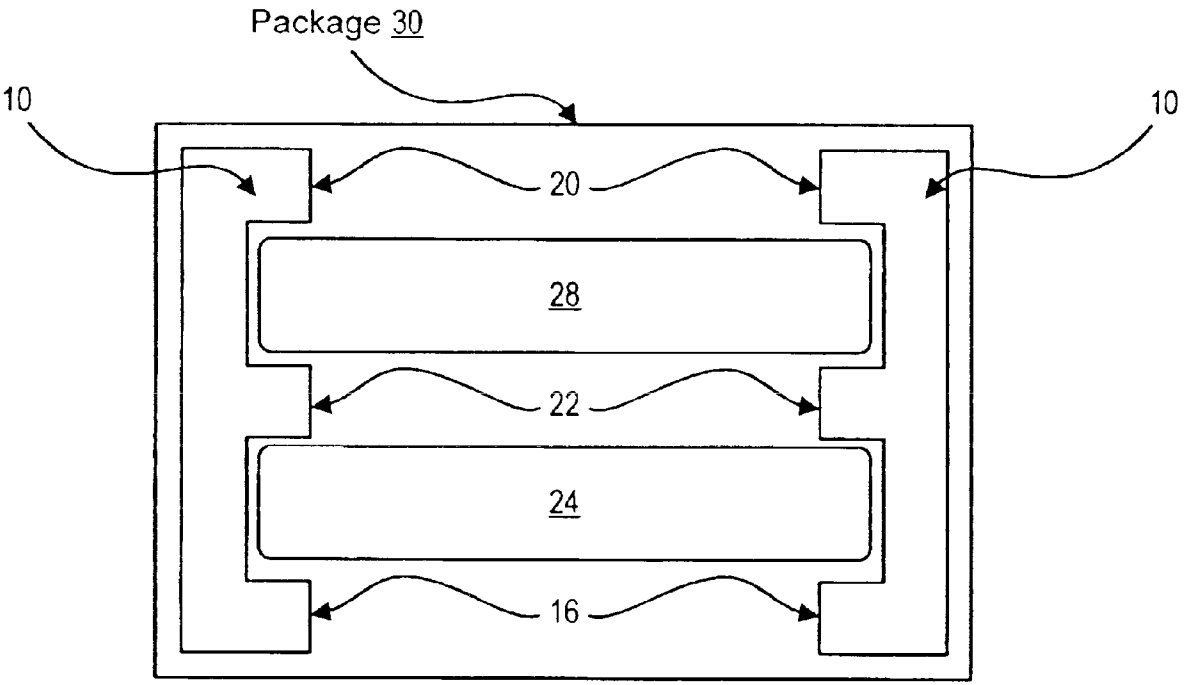
FIG. 5 depicts a side view of the packaging system supporting plural information handling systems in a package.

Referring now to FIG. 5, a side cutaway view of two information handling systems 24 and 28 is depicted. The plural information handling systems are loaded in a package 30 and supported by opposing packaging systems 10. Information handling system 24 is separated from information handling system 28 by intermediate support sections 22 which are pivoted inwards. The information handling systems are packaged with a horizontal orientation by first placing information handling system 24 on top of bottom support sections 16 which are pivoted inwards to separate information handling system 24 from the bottom surface of package 30. Intermediate support sections 22 are then pivoted inward over the top of information handling system 24 and information handling system 28 is placed on top of and supported by intermediate support sections 22. The packaging is completed by pivoting top support sections 20 over top of information handling system 28 and then securing the top of package 30. Additional information handling systems may be horizontally loaded in a package 30 by adding an intermediate support section to each packaging system 10 for each additional packaged system.

Although the present invention has been described in detail, it should be understood that various changes, substitutions and alterations can be made hereto without departing from the spirit and scope of the invention as defined by the appended claims.

What is claimed is:

1. A multi-product shipping system comprising:

a package having an interior to hold plural products;

first and second opposing pieces of packaging material, each having a pivotable intermediate section approximately aligned along a horizontal plane, the intermediate sections operable to pivot to expose upper and lower support surfaces having a support length;

a first product having first and second opposing sides, the first product disposed in the package with the first side beneath and adjacent to the support length of the first intermediate section and the second side beneath and adjacent to the support length of the second intermediate section; and a second product having first and second opposing sides, the second product disposed in the package with the first side above and adjacent to the support length of the first intermediate section and the second side above and adjacent to the support length of the second intermediate section;

wherein the upper and lower support surfaces of the intermediate sections provide packaging support between the first and second products.

2. The multi-product shipping system of claim 1 further comprising one or more additional products, the opposing pieces of packaging material each having an additional intermediate section for each additional product.

3. The multi-product shipping system of claim 1 wherein the products comprise information handling systems.

4. The multi-product shipping system of claim 3 wherein the information handling systems comprise servers ordered to fit in a server rack.

* * * * *